US005233395A

United States Patent [19]

Kohyama

[11] Patent Number: 5,233,395

[45] Date of Patent: Aug. 3, 1993

[54] IMAGE FORMING APPARATUS HAVING A TRANSFER BRUSH OF ELECTROCONDUCTIVE FIBERS

[75] Inventor: Mitsuaki Kohyama, Tokyo, Japan

[73] Assignee: Kabushiki Kaisha Toshiba, Kawasaki, Japan

[21] Appl. No.: 831,068

[22] Filed: Feb. 4, 1992

[30] Foreign Application Priority Data

Mar. 30, 1991 [JP] Japan ..... 3-67358

[51] Int. Cl.[5] ..... G03G 15/16; G03G 15/14

[52] U.S. Cl. ..... 355/274; 355/219; 355/271; 355/273; 355/277

[58] Field of Search ..... 355/271/273, 274, 277, 355/219; 430/126

[56] References Cited

U.S. PATENT DOCUMENTS

| | | | |
|---|---|---|---|
| 4,183,655 | 1/1980 | Umahashi et al. | 355/274 |
| 4,341,456 | 7/1982 | Iyer et al. | 355/274 |
| 4,903,081 | 2/1990 | Takahashi | 355/274 |
| 5,081,501 | 1/1992 | Waki et al. | 430/126 X |

FOREIGN PATENT DOCUMENTS

| | | | |
|---|---|---|---|
| 0029838 | 3/1980 | Japan | 355/271 |
| 0023982 | 2/1982 | Japan | 355/273 |
| 0254172 | 12/1985 | Japan | 355/271 |
| 0050562 | 3/1991 | Japan | 430/126 |
| 0131884 | 6/1991 | Japan | 355/271 |

*Primary Examiner*—A. T. Grimley
*Assistant Examiner*—Matthew S. Smith
*Attorney, Agent, or Firm*—Foley & Lardner

[57] ABSTRACT

An image forming apparatus includes a transfer brush for transferring to a paper sheet a developed image on an photoconductive drum. The transfer brush is formed in a plate-like shape by a number of electroconductive fibers bundled together. The transfer brush has a contact portion set in elastic contact with the drum. The brush presses the paper sheet, which is fed by the feeding device, against the drum under a predetermined pressing force. A DC current supply applies voltage to the paper sheet through the transfer brush so as to electrostatically attract the developed image to the paper sheet. The transfer brush is inclined to the image carrier so as to allow the paper sheet to be guided into an area between the drum and the transfer brush.

12 Claims, 5 Drawing Sheets

IMAGE FORMING APPARATUS HAVING A TRANSFER BRUSH OF ELECTROCONDUCTIVE FIBERS

BACKGROUND OF THE INVENTION

1. Field of the Invention

The present invention relates to an image forming apparatus, such as an electrophotographic apparatus, electrostatic printer, etc., and in particular to an image forming apparatus for transferring an image which is obtained by developing an electrostatic latent image to a transfer material, such as a paper sheet, by a transfer device.

2. Description of the Related Art

An image forming apparatus, such as an electrophotographic apparatus and electrostatic printer, is adapted to form an electrostatic image on a photoconductive drum (image carrier), electrostatically attract a developing agent to the electrostatic latent image to provide a developed image and transfer the developed image to a paper sheet so that recording is carried out.

An electrostatic transfer device using a corona transfer method or roller transfer method, as well as a mechanical transfer device using an adhesive transfer method, etc., are known as the transfer device in this field of art.

After transfer has been effected, there remains an electrostatic latent image and untransferred developing agent on the photoconductive drum. The remaining developing agent is removed by a cleaner. Then, the electrostatic latent image is erased by a discharger. In this way, the above-mentioned operations are repeated.

Recently, a growing demand has been made for more and more compact image forming apparatus. The generation of ozone caused upon corona discharge poses a problem harmful to the human being when the electric transfer device is employed. For this reason, the transfer device using the roller transfer method is desirable because it generates less ozone.

In spite of that major advantage of the roller transfer method, there are several reasons for which this method has generally not been employed.

For the roller transfer method it is necessary that a transfer material, such as a paper sheet, be pressed against the image forming surface of the photoconductive drum by the transfer roller under proper pressure and applied voltage. If the pressure is insufficient, uneven transfer is encountered. Under excessive pressure, on the other hand, a developing agent (toner) is adhered to the image forming surface of the drum so that an image transfer is partially skipped on the paper sheet. It is, therefore, necessary to manufacture that transfer roller with high mechanical accuracy (straightness about 50 microns) and proper pliability (JIS hardness of about 10° to 40°). However, electroconductive rubber used as a material for the conventional transfer roller can hardly achieve the above two requirements.

Specifically, if a paper sheet as thick as 100 microns is used, a defective image transfer occurs owing to the generation of excessive pressure involved. In this case, it is necessary to perform complex control wherein the transfer roller is moved toward and away from the photoconductive drum so as to enable the transfer roller to meet the thickness of the paper sheet.

It is generally also necessary to exert an electrostatic force on the developed image so that, subsequent to transferring the developed image to the paper sheet, the resultant paper sheet is separated from the transfer roller. In order to generate such an electrostatic force, the transfer roller has a predetermined electrical resistance. It is required that, under all the circumferences, the aforementioned resistance be so maintained as to prevent a breakdown of a recording medium by the electrostatic force. This restricts the range in which the material for the transfer roller is selected.

In order to solve the aforementioned problems under these backgrounds, there is a demand for an image forming apparatus adequate enough to satisfy these required characteristics.

SUMMARY OF THE INVENTION

It is accordingly the object of the present invention to provide an image forming apparatus of very simple arrangement which requires no mechanical allowance for accuracy, generates less ozone and can properly transfer a developed image to a transfer material (paper sheet).

In order to achieve the aforementioned object, according to the present invention, transferring means for transferring a developed image which is formed on the image carrier to a transfer material includes an electroconductive and elastic plate-like member. The plate-like member has a contact portion set in sliding contact with the image carrier and a supporting portion spaced apart from the contact portion and presses a transfer material, which is passed through an area between the contact portion and the image carrier, against the image carrier so that the developed image on the image carrier is transferred to the transfer material.

By pressing the transfer material against the image carrier by means of the electroconductive plate-like member, a pressing force suitable to a proper image transfer can be obtained within a greater mechanical allowable range. It is also possible to perform the image transfer without generating ozone.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

FIGS. 1 to 5 show an image forming apparatus according to an embodiment of the present invention, in which FIG. 1 is a cross-sectional view showing a whole arrangement of the present apparatus, FIG. 2 is a cross-sectional view showing a transfer device in the present apparatus, FIG. 3 is a perspective view showing a transfer brush, FIG. 4 is a graph for comparing relationship between the amount of bite of the transfer brush onto a photoconductive drum and the involved in the brush, with the relationship between them in the case wherein a transferred roller is used, and FIG. 5 is a graph showing the relationship between a bias voltage applied to the transfer brush and time;

DETAILED DESCRIPTION OF THE PREFERRED EMBODIMENTS

An embodiment of the present invention will now be described in detail with reference to the accompanying drawings.

Figure 1:
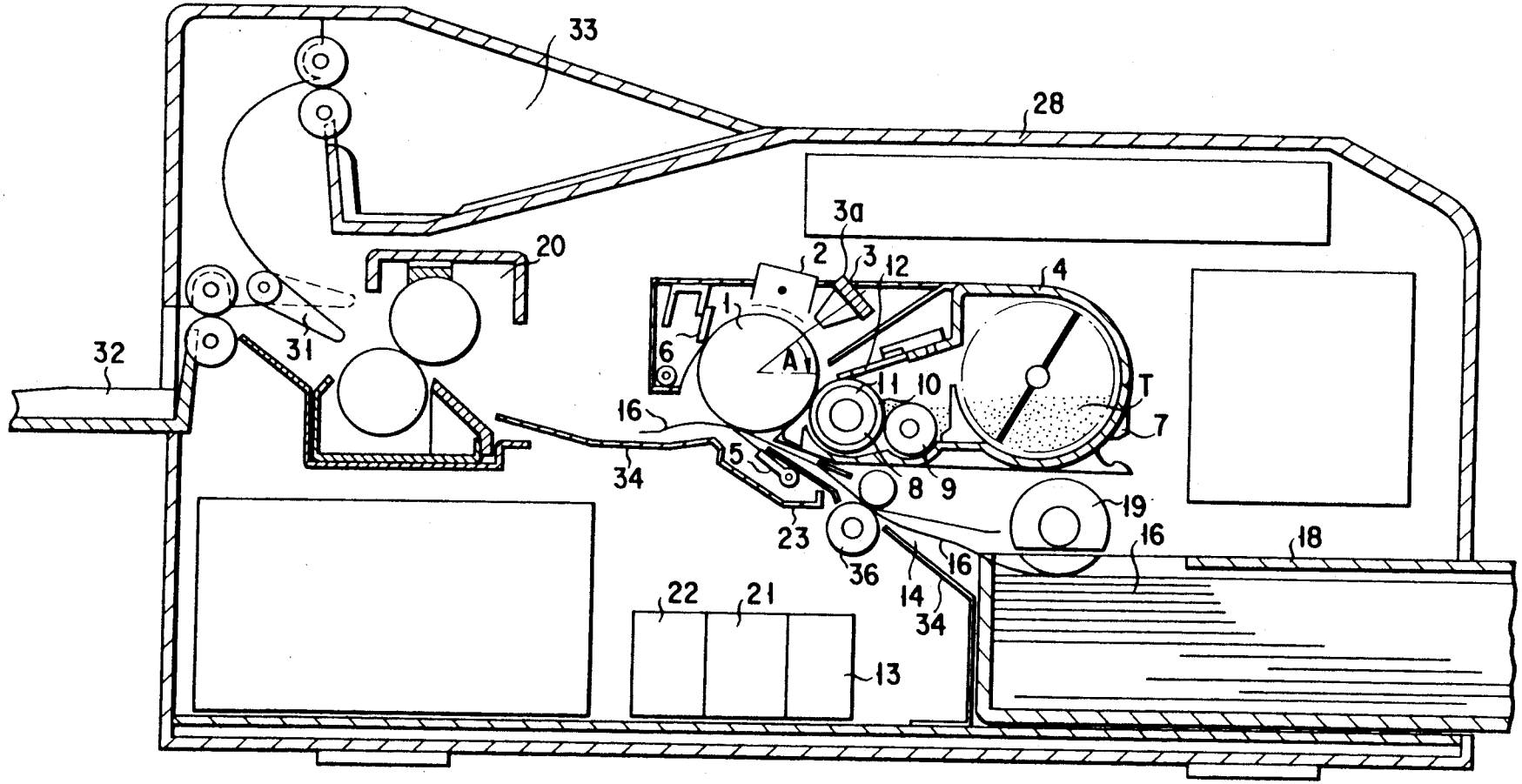

As shown in FIG. 1, an image forming apparatus of this embodiment has a housing 28. Substantially at the center of the housing, a photoconductive drum 1 serving as an image carrier is arranged and rotatable in a direction indicated by an arrow A in FIG. 1.

The outer peripheral surface of the photoconductive drum 1 is made of an organic photoconductor (OPC) based photoconductive material.

A charger 2, exposure device having a light emitting diode (LED) array 3*a*, developing device 4, transfer device 5 and cleaning device 6 are arranged in this order around the drum 1 in the rotating direction A. The charger 2 and exposure device constitute electrostatic latent image forming means in the present invention.

The charger 2 is located above the drum 1 and negatively charges the surface of the drum 1 substantially uniformly to −500 to −800 volts. In accordance with image information to be recorded, the exposure device 3 emits LED light onto the surface of the drum 1 to form an electrostatic latent image on the charged area of the drum surface. Further, the developing device 4 has a hopper 7 which stores a one- component developing agent (toner) T whose average particle size is of the order of 5 to 15 micrometers and has a triboelectrically chargeable characteristic. In the hopper 7 are arranged a developing roller 8 set in rolling contact with the drum 1 and a rotatable intermediate roller 9 for supplying the developing agent T to the developing roller 8. The developing roller 8 supplies the developing agent which is fed from the intermediate roller 9 to the photoconductive drum 1, thereby developing the electrostatic latent image on the surface of the drum.

The developing roller 8 has a conductive surface layer 10 formed of an electroconductive, elastic resin having a resistance of $10^2$ to $10^8$ Ωcm, and an elastic layer 11 formed of expanded urethane or, silicone rubber, EPDM, etc., and is located inside the surface layer, thus forming the elastic roller.

An elastic blade 12 is urged against the surface layer 10 of the developing roller 28 to enable a thin layer of the developing agent T to be formed, while triboelectrically charging the developing agent T. The elastic blade 12 is formed, e.g., of phosphor bronze, urethane or silicone rubber. The developing agent T passing through the blade 12 is triboelectrically charged to a negative polarity or a polarity the same as that of the drum 1, and a developing agent layer of a one- or two-layered structure is formed on the outer circumferential surface of the developing roller 8. The surface layer material of the developing roller 8 has to be selected, taking into consideration the triboelectricaly chargeable characteristic of the developing agent and proper elasticity and friction characteristic. A bias power supply 13 is connected, as a voltage applying means, to the developing roller 8 and electric connection is made to the surface layer 10 of the developing roller. By so doing, a predetermined developing bias (−140 to −400 V) is applied to the roller 8 at a time of development.

Figure 2:
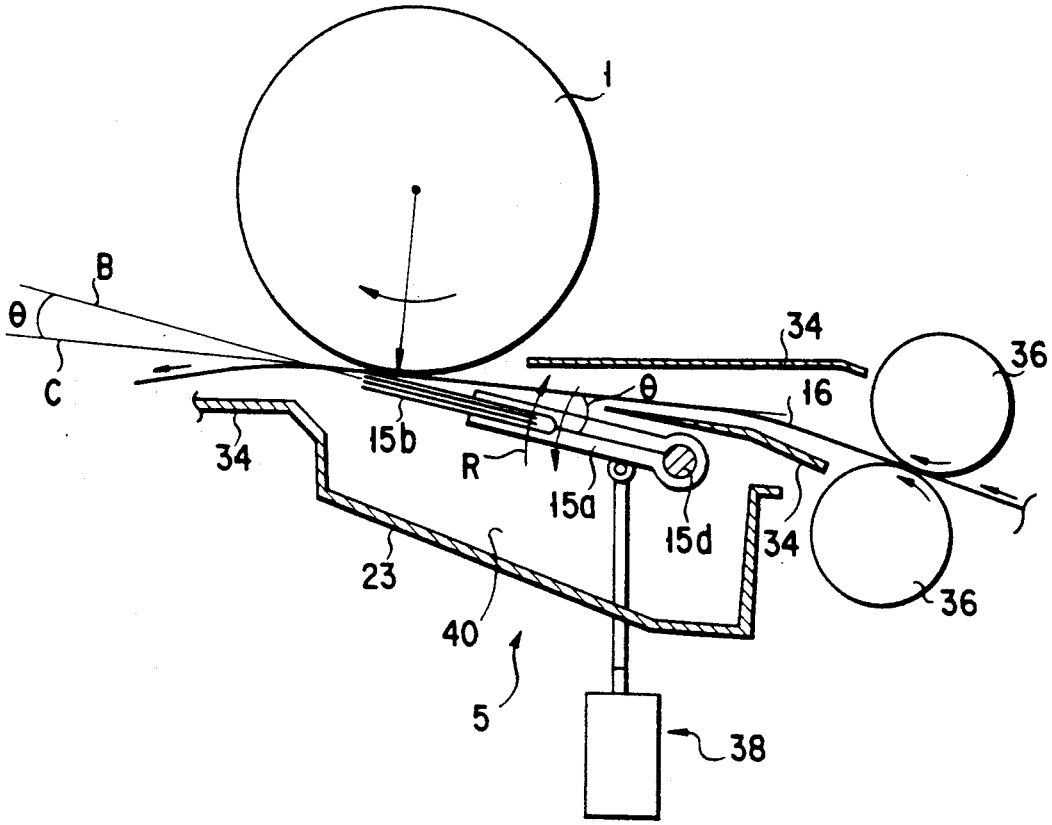

As shown in FIGS. 1 and 2, a paper sheet cassette 18 is provided in a right lower zone of the housing 28 and stores paper sheets 16 as transfer materials to which an image is transferred. A plurality of sheet guides 34 are arranged in the housing 28 to define a feeding path 14 extending from the cassette 18 past the photoconductive drum 1 to a fixing device 20. A supply roller 19 is arranged above the cassette 18 to supply paper sheets 16 one by one from the cassette to the feeding path 14 through the rotation of the roller. Aligning rollers 36 are provided in the feeding path 14 at an area between the cassette 18 and the drum 1 to set the coming paper sheet 16 to the drum 1 in an aligned relation. The aligning rollers 36 prevent a double-sheet feed.

The transfer device 5 is located substantially beneath the photoconductive drum 1 to face the outer circumferential surface of the drum 1 with the feeding path extending between the transfer device and the drum.

Figure 3:
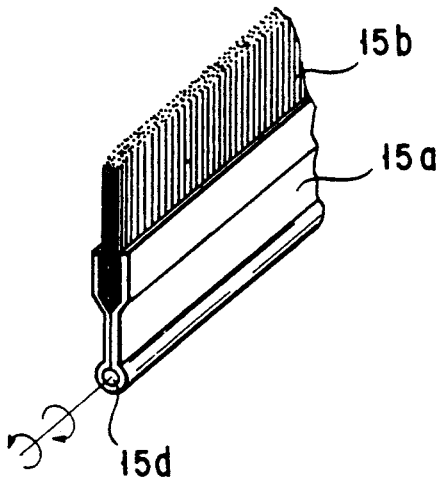

As shown in FIGS. 2 and 3, the transfer device 5 has a support member 15*a* made of an electroconductive metal. The support member 15*a* is rotatably supported by a support shaft 15*d* on a frame, not shown. The support shaft 15*d* is situated in a position lower than the feeding path 14. A transfer brush 15*b* is mounted on the free end of the support member 15*a*, which is distant from the support shaft 15*d*, and serves as an electroconductive plate-like member or sliding contact member having an elasticity. The transfer brush 15*b* is comprised of a bundle of electroconductive fibers which are arranged in a proper density into a plate-like form. Each of the fibers is formed of Rayon fiber admixed with electroconductive carbon. The brush 15*b* extends from the support member 15*a* across the feeding path 14 toward the photoconductive drum 1 such that its extended end portion is set in contact with the outer circumferential surface of the drum. Further, the brush 15*b* is set in sliding contact with, and at least across the effective image width of the drum 1, while the drum is rotated.

A voltage of 800 to 2000 volts is applied to the transfer brush 15*b*. The brush 15*b* contacts the rear surface of the paper sheet 16 fed on the feeding path 14 into an area between the brush and drum 1 and pushes the paper sheet against the drum 1. At that time, the paper sheet is charged to 400 to 800 volts by the transfer brush 15*b* and a toner image on the drum 1 is electrostatically attracted and transferred to the paper sheet 16.

Of importance to the transfer device 5 are the characteristics of the transfer brush 15*b* formed of electroconductive fibers.

Transfer brushes 15*b* using various types of electroconductive fibers were prepared and tested for their transfer characteristics. The explanation will be given below with respect to the preferable characteristics and shapes of the brushes.

With respect to the electric resistance of the fibers, five kinds of brushes were prepared, with an effective resistance range of $10^4$ to $10^{10}$ Ω/mm. For the thickness of the fibers, ten kinds of brushes were prepared in a range of 0.5 to 30 deniers.

Ten kinds of brushes were prepared with a brush fiber density (numbers/unit length) set in a range of 1 to 2000 fibers/mm. Brushes were also prepared properly in a range of 2 to 30 mm for the length of the brush fibers (the effective length of the brush fibers which does not include the length of the support portion 15*a*). The brushes were tested, under various pressing forces (the amount of flexing or support angle of the brush) relative to the drum surface, for the transfer characteristics.

As a result, it has been found difficult to bring the brush uniformly in contact with the paper sheet across the whole width of the paper sheet for the brush fiber length of less than 3 mm.

For the fiber length of 3 to 20 mm, it has been found that, as proper parameters, those pliable brushes of the order of 1 to 8 deniers are mechanically better and reveal a better transfer characteristic for a resistance of 105 to 109 Ω/mm per fiber.

It has also been found that these brushes whose fiber length is 12 to 30 mm are better for the fiber thickness of the order of 5 to 15 deniers.

From the above it will be seen that, though not checked, a fiber length exceeding the aforementioned length is effective to the transfer device if it is a proper length. However, for the fiber length exceeding 30 mm, the apparatus becomes bulkier and of no practical significance.

For the brush fiber density (number/unit length) set, experiments need selectively be conducted to determine not only the thickness and length but also the strength with which the paper sheet is urged against the photoconductive drum 1. Further consideration has to be given to, among other things, the brush fiber density.

If the brush fiber density is decreased below a given level in order to adjust the brush's strength with which the paper sheet is urged against the drum 1, then a defective image area called a "skipped transfer spot" occurs in the direction of a continuous image.

Normally, upon application of a voltage to the brush, a local discharge occurs from the distal end of the fiber to the paper sheet during transfer, thus electrically charging the paper sheet. If there is too great a distance between the distal end portions of the respective fibers due to that sparse density, then a sporadically charged area or areas occur on the paper sheet, thus causing an image area or areas to be partially skipped without being transferred to the paper sheet.

The "skipped spot or spots of image" may occur depending upon the kinds of paper sheets to be used as well as the ambient humidity. It has been found that such skipped spots rarely occur on the usually employed paper sheet for a relative humidity of about 30 to 70 percent when the distance between the distal end portions of the brush fibers is 1 to 2 mm or less.

As evident from the above, the parameters involved have to be determined in order of (1) the brush fiber density (more fibers are employed so that fiber-to-fiber distance is preferably 1 mm or less and (2) a thickness/-length suitable to the determined density is selected.

The brush fiber density may vary depending upon the kinds of paper sheets employed. The highest density is required for a transparent film whose electrical resistance is high. In this case, it is necessary to employ 10 or more fibers per mm. Three or more fibers per mm serves the purpose for paper sheets which are normally used in the field of art.

In the case where the number of brush fibers is the least available limit, the brush fiber density is irregularly deviated due to a variation of the fibers with time, thereby being liable to generate a defective transfer. Further, since the force with which the brush mechanically presses the paper sheets against is lowered, an elastic backup member, for example, is required to support the brush from behind. Therefore, it is preferred to employ more fibers for the brush, if possible, provided that the fibers are as fine as practical.

From the above, it has been found that the transfer brush 15*b* of proper transfer characteristics can be made from the optimal conditions such that the brush fiber density is set at 3 or more fibers per mm, most preferably 100 to 800 fibers per mm; that the thickness of the brush fibers is in a range of about 1 to 15 deniers so as to provide proper flexibility (the thickness is selected in relation to the length of the fibers); that the length of the fibers is set in a range of about 3 to 30 mm; and that the conductivity is so adjusted as to set the resistance (per fiber) at $10^5$ to $10^9$ Ω/mm.

Comparison was made in transfer characteristics between the transfer device 5 equipped with a brush 15*b* of 700 fiber/mm having the fiber thickness of 4 deniers and fiber length of 17 mm and a conventional transfer roller formed of an electroconductive rubber having the most preferable flexibility (JIS hardness 30°).

Figure 4:
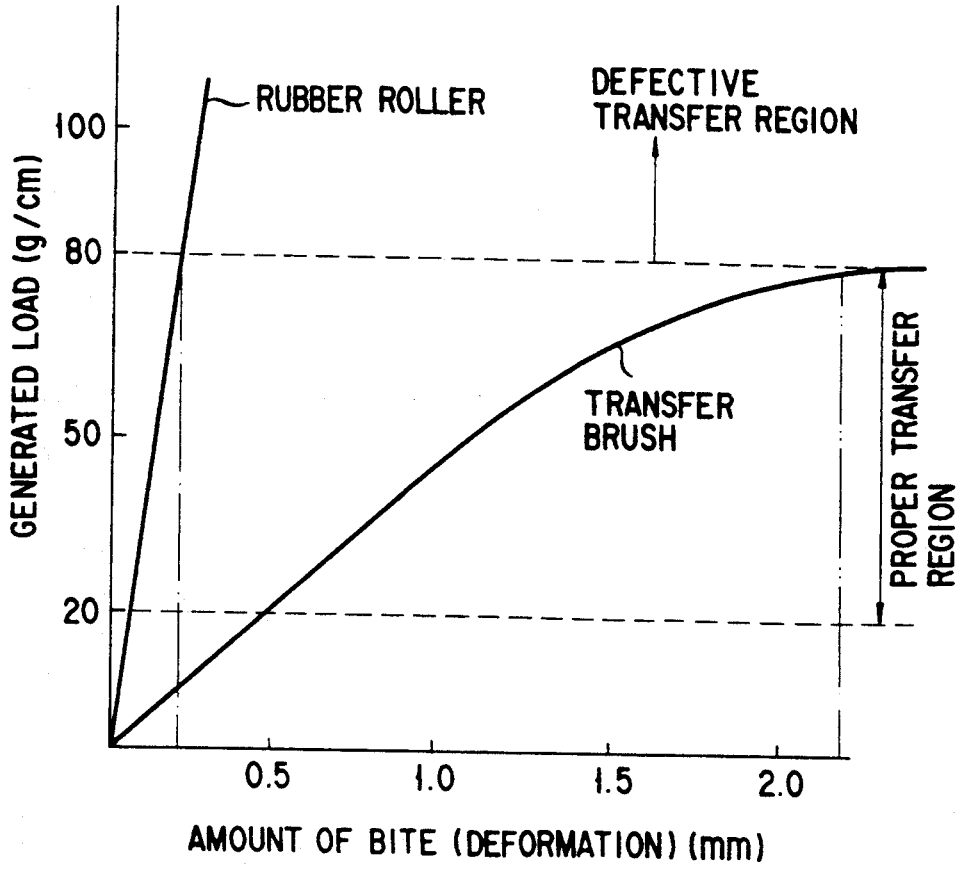

Comparison was also made between the transfer brush and the transfer rubber roller with respect to the allowable range of their bite onto the photoconductive drum 1, that is, the required mechanical allowable accuracy, noting that, for the transfer brush, the amount of bite or deformation was measured by varying the support angle of the brush. FIG. 4 shows a result of measurement made on a spring balance so as to obtain a relation between the amount of bite of the rubber roller and brush, that is, the displacement distance on the spring balance, and an indicated value on the spring balance (a value obtained through a division with a length of contact over which the transfer brush or transfer roller is pressed against the spring balance).

The roller and transfer brush were also tested for their state of image transfer. It has been found that the image transfer is partially skipped on the paper sheet when the roller and brush are pressed against the photoconductive drum under a load of over 80 g/cm. Under a relative humidity of over 80%, it has been found that, even under a smaller press load, such as about 20 g/cm or below, the image transfer is partially skipped on the paper sheet due to less mechanical contact of the paper sheet with the drum and to less electrical charging of both.

Upon plotting these results on the result of measurement of FIG. 4, it will be seen that, upon transfer by a conventional rubber roller, the amount of mechanical bite for proper transfer to be conducted is in a range of 0.15±0.05 mm. For the transfer brush 15*b* it will be appreciated that a better image transfer can be made in a bite range of 1.2±0.7 mm and that a mechanical allowable range of actually over 10 times that of the aforementioned range is obtained. Therefore, use of the transfer brush can lower the required accuracy with which the associated components are manufactured and assembled. It is thus found possible to solve the problem 3 relating to the mechanical accuracy in the manufacture and assembling encountered as a practical major problem for the rubber roller.

In order to maintain the above-mentioned mechanical accuracy, it is only necessary that, as shown in FIG. 2, an angle between a line B passing through an area of contact of the transfer brush 15*b* with the photoconductive drum 1 and through the support shaft 15*d* of the support member 15*a*, and a line C tangent to that contact area at the drum 1, that is, a a support angle $\theta$ be set in a range of 0 to 60 degrees, preferably about 5 to 45 degrees. By varying the support angle within the aforementioned range, it is possible to adjust the amount of bite (deformation) of the brush 15*b* onto the photoconductive drum, that is, a pressing force of the brush 15*b* onto the drum.

The reason why the extended end portion of the transfer brush 15*b* is inclined in a downstream direction to the line C is not only because the pressing force of the brush is controlled but also because the paper sheet 16 fed to the transfer area is guided more smoothly. According to this embodiment, the support shaft 15*d* of the support device 5 is located below the feeding path 14 and positioned on the upstream side of the drum 1, as viewed in the direction in which the paper sheet is fed. The transfer brush 15*b* and support member 15*a* are so arranged as to be inclined at the support angle $\theta$.

For this reason, the brush 15*b* has the function for guiding the paper sheet 16, being fed along the feeding path 14 and guided by the sheet guides 34, to the transfer area, that is, to the area of contact of the brush 15*b* with the drum 1.

It is not preferable that, upon assembly, the distal end of the transfer brush 15*b* be floated from the photoconductive drum 1. It is necessary that the distal end portion of the brush be arranged so as to make contact with the drum either at the distal end portion or desirably at that side face area near the distal end. In that state, the paper sheet is easier to pass the transfer area in the least uneven state of electric charge without being mechanically hindered.

As evident from the above, with the transfer brush formed of elastic fibers, according to this embodiment, it is an advantage for the pressing force against paper sheets to be easily maintained at 80 g/cm or less, which is optimum for image transfer, without requiring high mechanical accuracy.

Such a contact type transfer device exhibits its stable transfer characteristic even under high humidity conditions and, hence, reduces the amount of developing agent remaining on the drum due to the defective transfer, offering the advantage of alleviating a cleaning load involved. Further, the transfer device has the advantage of removing any paper dust resulting from the paper sheet and alleviating the cleaner's burden, thus achieving added reliability.

According to the image forming apparatus described above, in the image forming operation, a toner image which is developed by the developing agent on the outer circumferential surface of the photoconductive drum 1 is fed to the transfer area with the rotation of the drum. In synchronism with the rotation of the drum 1, a paper sheet 16 is supplied by the supply roller 19 from the cassette 18 to the transfer area along the feeding path 14. The paper sheet 16 is pressed by the transfer brush 15*b* against the outer circumference of the drum 1 under a predetermined pressing force and, at the same time, electrically charged at its rear surface with a positive polarity. Thus the toner image on the circumferential surface of the photoconductive drum 1 is electrostatically attracted to the paper sheet 16 so that an image transfer may be carried out.

At the end of the feeding path 14, the fixing device 20 is provided where the transferred toner image on the paper sheet is fixed to the paper sheet. Thereafter, the paper sheet 16 is selectively discharged to a first discharge section 32 or to a second discharge section 33 by a gate 31 which is provided on the discharge side of the fixing device 20.

A voltage of 800 to 2000 volts is applied, upon transfer, from a DC current supply 21 to the transfer brush 15*b* via the electroconductive support member 15*a*. The transfer brush 15*b* becomes soiled during use, due to the toner deposition, etc. In order to prevent soiling of the transfer brush to a non-allowable extent, the brush 15*b* and support member 15*a* are rotatable about the support shaft 15*d* as indicated by an arrow R in FIG. 2. If there exists no paper sheet at the transfer area, the brush 15*b* and support member 15*a* are rotated away from the photoconductive drum 1 by a separation mechanism 38.

Therefore, the soiling of the transfer brush 15*b* can be reduced to a possible allowable low extent and hence no inconvenience is encountered upon the printing of up to 20,000 copies.

It is, however, necessary to clean the brush over an extended period of time in spite of the situation above.

In the present embodiment, therefore, a voltage of −100 to −300 volts (negative in this case) the same in polarity as that of the toner is applied to the transfer brush 15, at a non-transfer time, via another power supply 22 provided separately from the DC power supply 21 for the transfer brush 15*b*. By so doing, the toner which is deposited on the brush 15*b* can be attached to the photoconductive drum 1 side, thereby cleaning the brush.

Another method for cleaning the transfer brush 15*b* comprises simply making a voltage being applied to the transfer brush 15*b* a zero value during a time period in which the transfer brush 15*b* is in contact with a non-transferred area on the photoconductive drum 1. This method can somewhat slightly remove the toner. A cleaning effect is also obtained by passing the transfer brush through the non-transferred area on the drum 1 with a zero charge created at that non-transferred area on the drum 1. It is preferable that any of these cleaning means be employed for a continuous operation to be done on the image forming apparatus.

It has been found that, by these cleanings as set out about, the transfer brush 15*b* can maintain a better transfer function upon the printing of over 100,000 copies.

The tests were made, for a transfer state, under a varying ambient relative humidity of 30 to 80%. It has been found that, under an ambient humidity condition of over 70%, an obviously high transfer percentage (a percentage of the residual toner to an amount of toner on the photoconductive drum before the transfer of the toner image) is advantageously obtained when compared with the corona discharge method.

Further study on the bias voltage to be applied to the transfer brush 15*b* reveals an unexplainable phenomenon as will be set out below.

That is, even immediately after the DC power supply 21 is turned ON at a time of printing on the image forming apparatus or even when the DC power supply 21 is turned OFF at the end of that operation on the image forming apparatus, the toner deposited on the transfer brush 15*b* is released all at a time onto the outer circumferential surface of the photoconductive drum 1 and deposited in the form of a band.

This is a favorable phenomenon for brush cleaning, if the subsequent cleaning can be done by the cleaner 6. However, much toner may sometimes be deposited on the drum surface and the subsequent cleaning becomes insufficient, thus adversely affecting the subsequent image formation.

Figure 5:
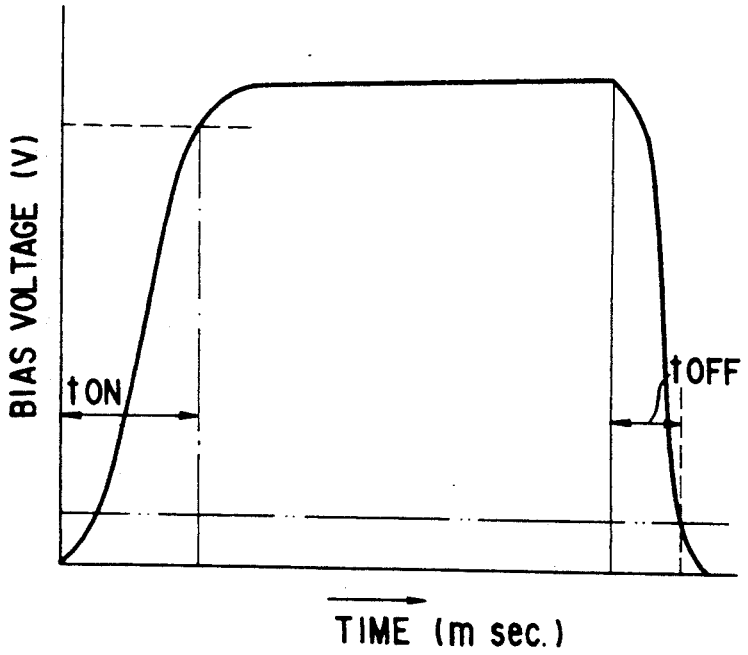

Further study has been made for the causes for such a phenomenon. As a result, it has been found that this phenomenon prominently occurs in the case where, as shown in FIG. 5, the time tON in which a bias voltage applied to the transfer brush 15*b* rises to 90% of its desired value at a switch ON time or the time tOFF in which the bias voltage falls to about 10% of its desired value at a switch OFF time is below 20 mm sec.

From this it may be assumed that, due to the induction of a counter electromotive force caused by the electrical resistance and electrostatic capacitance of the transfer brush 15*b*, the toner of the same polarity is released through repulsion.

In either case, the aforementioned rise and fall times are preferably increased above 20 mm sec. by adding, for example, a circuit comprised of a capacitor and resistor to the present apparatus so as to slow the output of the bias DC power supply. This phenomenon is completely eliminated by using a DC power supply for gradually outputting a voltage over a range of about 50 to 150 mm sec.

A receiving tray 23 is arranged below the brush and support member 15*a* to receive some toner if it should fall from the transfer brush 15*b*, etc. The tray 23 is formed integral with a portion of the sheet guides 34.

Further, if a thin paper sheet is used, it may be sometimes electrically charged by the transfer brush 15*b*, etc., prior to being brought into contact with the photoconductive drum 1. In this case, before the paper sheet contacts the drum 1, some toner corresponding to part of a toner image scatters, or is transferred, onto the paper sheet, causing a defective image, such as a blurred image.

Figure 6:
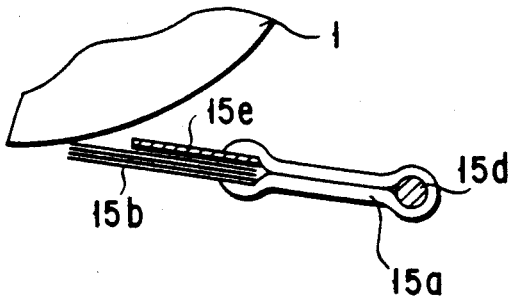
FIG. 6 is a schematic view showing a modification of the transfer brush.

As a countermeasure against this occurrence, an insulating elastic plate 15*e* about 0.1 to 3.0 mm thick, together with the transfer brush 15*b*, may be fitted into the support member 15*a*, as shown in FIG. 6. The elastic plate 15*e* is situated on the transfer sheet entry side of the transfer brush 15*b*, that is, on the transfer drum 1 side. The above-mentioned problem can be prevented because the paper sheet is not electrically charged immediately prior to being brought into intimate contact with the drum 1.

According to the transfer device 5 using the elastic conductive transfer brush 15*b*, it is possible to effectively transfer a developed image to the paper sheet such that the generation of ozone hardly occurs. It is easier to clean the transfer device. A better image transfer can be continually obtained under adverse environmental conditions. The transfer device is set in direct contact with the paper sheet 16 at a time of transfer, thus enabling paper dust, if any, on the paper sheet to be efficiently removed through attraction. After transfer has been achieved, any deposit remaining on the photoconductive drum 1 is much reduced, alleviating the cleaning burden on the cleaner 5.

Since the transfer device 5 has a greater mechanical allowance upon being mechanically pressed against the paper sheet 16, it is possible to effectively prevent an image transfer from being partially skipped on the paper sheet. In the case where a thick paper sheet is employed, in the conventional roller transfer method in particular, the pressing force involved exceeds an allowable extent, placing some restriction on the application of the conventional method, such as requiring a complex associated mechanism. Of particular significance is the fact that, since a greater allowable amount of bite can be accommodated in the transfer device of the present apparatus, a clear image can be transferred to the paper sheet without being affected by the thickness of the paper sheet.

The present invention is not limited to the above-mentioned embodiment, and various changes or modifications can be made without departing from the spirit and scope of the present invention.

For example, as the conductive fiber material, use may also be made of other materials, such as an acrylic- and nylon-based resin, if they possess the proper flexibility and mechanical strength, dispersibility with carbon, etc.

Figure 7:
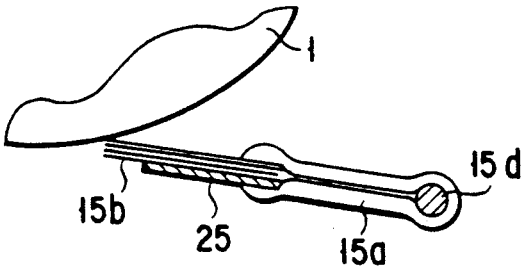
FIG. 7 is a schematic view showing another modification of the transfer brush.
Figure 8:
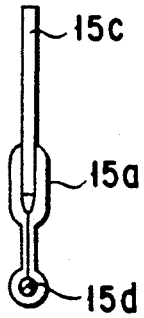
FIG. 8 is a side view showing a transfer member in another embodiment of the present invention.

As shown in FIG. 7, an elastic back-up plate 25, such as a polyester film, may provided on the lower surface side of the transfer brush 15*b*. The distal end portions of the transfer brush 15*b* may be set in pressure contact with the photoconductive drum 1 with a mechanical load applied by the back-up plate 25.

Although the aforementioned embodiment has been explained as using the brush by way of example, the present invention is not restricted to the use of the brush. Even in the case where use may be made of an elastic, electroconductive plate-like transfer member 15*c*, it is possible to obtain the same advantage by properly determining its thickness, its length (the effective length as viewed in the direction in which the member 15*c* is flexibly set in contact with the drum), its support angle (which determines an amount of bite and a pressing force), etc., in the same way as described above.

In the aforementioned embodiment, a relatively thin brush is used as a photoconductive plate-like member. However, a thick brush, such as a brush for cleaning shoes, may be used as the photoconductive plate-like member.

For the transfer member 15*c*, use is made of an excellent wear-resistant material of proper elasticity and electroconductivity prepared by kneading conductive carbon and urethane rubber (resin), or silicon rubber (resin), having elasticity. The transfer member thus prepared has a thickness of about 0.5 to 2 mm.

The conductive plate-like member 15*c*, like the transfer brush 15*b*, has its free end portion or its side face near the free end set in contact with the photoconductive drum 1 with a proper load applied there.

Figure 9:
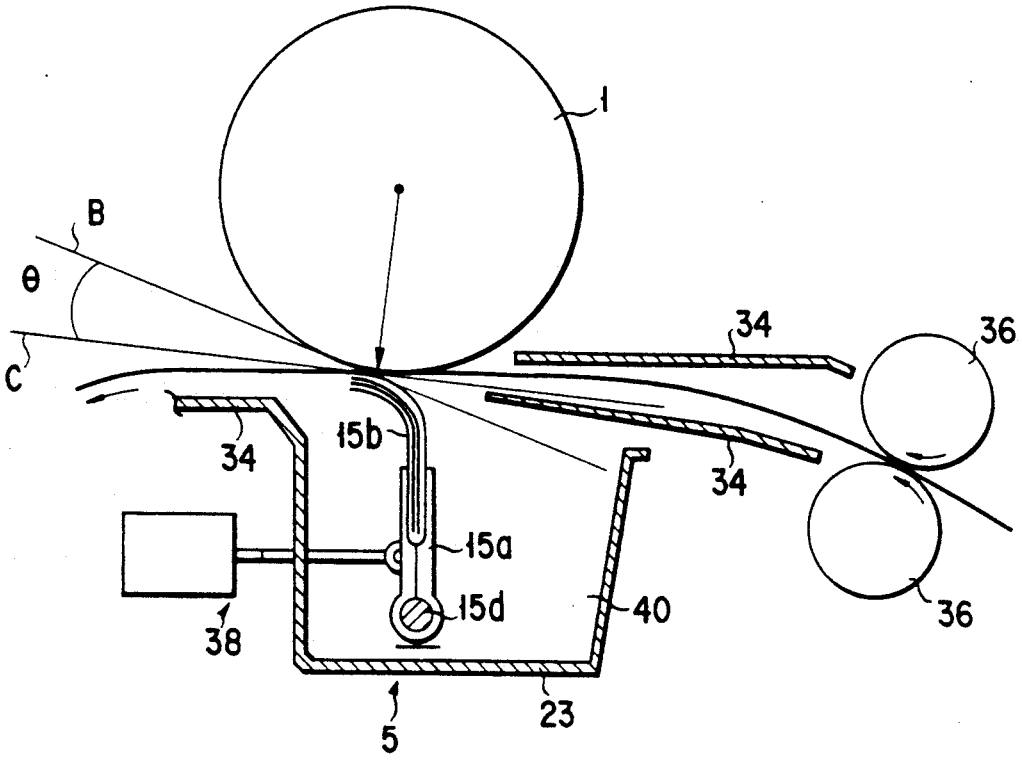
FIG. 9 is a schematic view showing a still another modification of transfer member.

Further, in the aforementioned embodiment, the whole transfer brush 15*b* is arranged to be inclined at a support angle $\theta$ to the line B tangent to the contact area of the photoconductive drum with the transfer brush. However, even if the transfer brush 15*b* and support member 15*a* are arranged as shown in FIG. 9, the same advantages as in the aforementioned embodiment can be obtained. In this modification, the distal end portion of the transfer brush 15*b* is in sliding contact with the photoconductive drum 1 while being bent so that the distal end portion is inclined at a predetermined angle $\theta$ (in a range of 0 to 60 degrees) to the line B tangent to the contact area of the drum 1 with the transfer brush. The remaining part of the transfer brush 15*b* and the support member 15*a* are arranged to extend in a direction substantially perpendicular to the line B.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. An image forming apparatus comprising:

means for forming an electrostatic latent image on an image carrier having a cylindrical surface;

means for developing the electrostatic latent image by a developing agent to provide a developed image;

means for feeding a transfer material to which the developed image is to be transferred; and means for transferring the developed image on the image carrier to the transferred material, the transferring means including:

an electroconductive plate-like member having a distal end portion which constitutes a contact portion set in elastic contact with the image carrier and a proximal end portion spaced away from the distal end portion, for pressing the transfer material, which is fed by the feeding means, against the image carrier under a predetermined pressing force, means for supporting the plate-like member so that the proximal end portion is located on an upstream side of the contact portion with respect to a feeding direction of the transfer material and so that the plate-like member is inclined at a predetermined angle $\theta$ to a tangent of that portion of the cylindrical surface of the image carrier which contacts the contact portion of the plate-like member, the predetermined angle $\theta$ being set in a range of $0<\theta\leqq 60$ degrees, means for applying a voltage to the transfer material through the plate-like member so as to electrostatically attract the developed image to the transfer material, and a covering member for covering a surface side of the plate-like member facing the image carrier, except for the contact portion, the covering member being formed of an insulating material having elasticity.

2. An apparatus according to claim 1, wherein the feeding means has a material feeding path extending through a position between the image carrier and the contact portion of the plate-like member.

3. An apparatus according to claim 1, wherein the supporting means includes a rotatable support member for supporting the proximal end portion of the plate-like member, and means for rotating the support member to a position in which the contact portion of the plate-like member is spaced away from the image carrier, while the contact portion faces an area where there is no developed image on the image carrier.

4. An apparatus according to claim 1, wherein the transferring means includes means for applying a voltage the same in polarity as the developing agent to the plate-like member so as to release developing agent deposited on the plate-like member to the image carrier side, while the contact portion of the plate-like member makes contact with that area of the image carrier where there is no developed image.

5. An apparatus according to claim 1, wherein the applying means includes means for lowering a voltage which is applied to the plate-like member to zero so as to release developing agent deposited on the plate-like member toward the image carrier side, while the contact portion of the plate-like member makes contact with that area of the image carrier where there is no developed image.

6. An image forming apparatus comprising:

means for forming an electrostatic latent image on an image carrier;

means for developing the electrostatic latent image by a developing agent to provide a developed image;

means for feeding a transfer material to which the developed image is to be transferred; and means for transferring the developed image on the image carrier to the transfer material;

the transferring means including:

an electroconductive plate-like member having a distal end portion which constitutes a contact portion set in elastic contact with the image carrier and a proximal end portion spaced away from the distal end portion, for pressing the transfer material, which is fed by the feeding means, against the image carrier under an predetermined pressing force, said feeding means having a material path extending through a position between the image carrier and the contact portion, means for supporting the plate-like member so that a line passing through the contact portion and the proximal end portion is inclined at a predetermined angle to the image carrier, the proximal end portion being located on an upstream side of the contact portion with respect to a feeding direction of the material, the feeding path passing between the proximal end portion of the plate-like member and the image carrier, means for applying a voltage to the transfer material through the plate-like member so as to electrostatically attract the developed image to the transfer material, and a covering member for covering a surface side of the plate-like member facing the image carrier, except for the contact portion, the covering member being formed of an insulating material having elasticity.

7. An apparatus according to claim 6, wherein the predetermined angle is set in a range of about 0 to 60 degrees.

8. An image forming apparatus comprising:

means for forming an electrostatic latent image on an image carrier;

means for developing the electrostatic latent image by a developing agent to provide a developed image;

means for feeding the transfer material to which the developed image is to be transferred; and means for transferring the developed image on the image carrier to the transfer material, the transferring means including an electroconductive plate-like member having a contact portion set in elastic contact with the image carrier, for pressing the transfer material, which is fed by the feeding means, against the image carrier under a predetermined pressing force, and means for applying a voltage to the transfer material through the plate-like member so as to electrostatically attract the developed image to the transfer material, the applying means including means for lowering the voltage which is applied to the plate-like member to zero, so as to release the developing agent deposited on the plate-like member toward the image carrier side, while the contact portion of the plate-like member makes contact with that area of the image carrier where there is no developed image.

9. An image forming apparatus comprising:

means for forming an electrostatic latent image on an image carrier;

means for developing the electrostatic latent image by an developing agent to provide a developed image;

means for feeding a transfer material to which the developed image is to be transferred; and means for transferring the developed image on the image carrier to the transfer material, the transferring means including an electroconductive brush-like member having a contact portion set in elastic contact with the image carrier, for pressing the transfer material, which is fed by the feeding means, against the image carrier under a predetermined pressing force, and means for applying a voltage to the transfer material through the brush-like member so as to electrostatically attract the developed image to the transfer material, the brush-like member having a large number of electroconductive fibers bundled together, the electroconductive fibers having a thickness range of about 1 to 15 deniers each, and electrical resistance range of about $10^5$ to $10^9$ Ω per mm each, a fiber density of over 3 fibers/mm, and an effective length of over 3 mm each.

10. An apparatus according to claim 9, wherein the transferring means includes means for supporting the plate-like member such that a load of contact of the contact portion with the image carrier is set to be in a range of about 20 to 80 g/cm.

11. An image forming apparatus comprising:

means for forming an electrostatic latent image on an image carrier;

means for developing the electrostatic latent image by a developing agent to provide a developed image;

means for feeding a transfer material to which the developed image is to be transferred; and means for transferring the developed image on the image carrier to the transfer material, the transferring means including an electroconductive plate-like member having a contact portion set in elastic contact with the image carrier, for pressing the transfer material, which is fed by the feeding means, against the image carrier under a predetermined pressing force, means for supporting the plate-like member so that an amount of deformation of the plate-like member onto the image carrier is in a range of about 0.5 to 3.0 mm, and means for applying a voltage to the transfer material through the plate-like member to electrostatically attract the developed image to the transfer material.

12. An image forming apparatus comprising:

means for forming an electrostatic latent image on an image carrier having a cylindrical surface;

means for developing the electrostatic latent image by a developing agent to provide a developed image;

means for feeding a transfer material to which the developed image is to be transferred; and means for transferring the developed image on the image carrier to the transfer material, the transferring means including:

an electroconductive plate-like member having a distal end portion which constitutes a contact portion set in elastic contact with the image carrier and a proximal end portion spaced away from the distal end portion, for pressing the transfer material, which is fed by the feeding means, against the image carrier under a predetermined pressing force, means for supporting the plate-like member so that the proximal end portion is located on an upstream side of the contact portion with respect to a feeding direction of the transfer material and so that the plate-like member is inclined at a predetermined angle $\theta$ to a tangent of that portion of the cylindrical surface of the image carrier which contacts the contact portion of the plate-like member, the predetermined angle $\theta$ being set in a range of $0<\theta\leqq 60$ degrees, and means for applying a voltage to the transfer material through the plate-like member to electrostatically attract the developed image to the transfer material, the applying means including means for lowering the voltage which is applied to the plate-like member to zero to release any developing agent deposited on the plate-like member toward the image carrier side, while the contact portion of the plate-like member makes contact with that area of the image carrier where there is no developed image.

* * * * *